United States Patent [19]

Mnilk et al.

[11] 4,431,224

[45] Feb. 14, 1984

[54] ARRANGEMENT FOR DISPLACING PIECE GOODS

[75] Inventors: Reinhold Mnilk, Dortmund-Wambel; Manfred Keil, Dortmund; Lothar Schulte, Dortmund-Asseln, all of Fed. Rep. of Germany

[73] Assignee: Holstein and Kappert GmbH, Dortmund, Fed. Rep. of Germany

[21] Appl. No.: 283,679

[22] Filed: Jul. 15, 1981

[30] Foreign Application Priority Data

Sep. 27, 1980 [DE] Fed. Rep. of Germany ... 8025903[U]

[51] Int. Cl.[3] ..... B66C 1/10

[52] U.S. Cl. ..... 294/87 R; 294/81 R; 294/67 BC

[58] Field of Search ..... 294/87 R, 81 R, 81 F, 294/88, 93, 95, 97, 67 R, 67 B, 67 BA, 67 BB, 67 BC, 67 DA, 120, 128

[56] References Cited

U.S. PATENT DOCUMENTS

| | | | |
|---|---|---|---|
| 2,377,845 | 6/1945 | Westfall | 294/87 R |
| 3,157,425 | 11/1964 | Thomas | 294/87 R |
| 4,288,904 | 9/1981 | Lindberg | 294/87 R |
| 4,355,833 | 10/1982 | Dunbar | 294/87 R |

*Primary Examiner*—James B. Marbert

*Attorney, Agent, or Firm*—Michael J. Striker

[57] ABSTRACT

An arrangement for displacing piece goods has a plurality of supporting shafts and a plurality of grippers mounted on the supporting shafts so that when some of the grippers come into contact with the piece goods at location whereat no gripping openings are provided they do not prevent other of the grippers from unobjectionable engagement into the openings of the piece goods, and the grippers are provided in such a number that they can engage in the openings arranged in accordance with any of the different opening patterns.

3 Claims, 2 Drawing Figures

ARRANGEMENT FOR DISPLACING PIECE GOODS

BACKGROUND OF THE INVENTION

The present invention relates to an arrangement for displacing piece goods. More particularly, it relates to an arrangement for displacing or turning piece goods having gripping openings provided in their lateral surfaces, wherein the arrangement is composed of several gripper shafts with hook-shaped grippers mounted thereon.

The arrangements of the above-mentioned general type are known in the art. In a known arrangement for loading and unloading of pallets, the hook-shaped grippers are fixedly mounted on a gripper shaft which rotates within a predetermined angular distance. When the arrangement is designed in accordance with this construction, the piece goods with only a predetermined position pattern or surface pattern can be gripped, and more particularly such piece goods whose receiving openings correspond to the number and arrangement of the hook-shaped grippers. When it is necessary to work with different surface patterns, the known gripping arrangement must be adjusted to the new formation during each displacing step. For this purpose it is necessary to utilize special sensing devices which upon reaching of one position below the gripping arrangement sense this position and act upon the respective hook-shaped grippers on the gripper shaft. This arrangement is characterized by considerable disadvantages in the sense of its construction. Moreover, the requirement to sense each position for determination of the available gripping openings causes a considerable time loss.

SUMMARY OF THE INVENTION

Accordingly, it is an object of the present invention to provide an arrangement for displacing piece goods which avoids the disadvantages of the prior art.

More particularly, it is an object of the present invention to provide an arrangement for displacing piece goods, which operates regardless of the pattern of the gripping openings provided on the lateral surfaces of the piece goods.

Particularly, it is an object of the present invention to provide such an arrangement in which, when the supporting shaft turns to the gripping position, the grippers act automatically so that some of the grippers engages into the openings of the piece goods, whereas the other grippers which do not engage into the openings are deflected without applying an undesirable force to the outer walls of the box or piece goods.

In keeping with these objects and with others which will become apparent hereinafter, one feature of the present invention resides in the fact that the grippers are arranged on the supporting shafts so that there is no resistance when they do not engage into the openings of the piece goods, and the grippers are provided in such a number that they can engage in the openings arranged in accordance with any of a plurality of different opening patterns.

More particularly, the grippers are mounted on the gripper shaft so that they are turnable relative thereto within a predetermined angular region and outside their centers of gravity.

In accordance with another advantageous feature of the present invention, the hook-shaped grippers have a follower pin which cooperates with a stop provided on the gripper shaft so that when the gripper shaft turns to the opening position, the grippers are turned from their self-holding position to their releasing position.

When the arrangement is designed in accordance with the present invention, it is possible to displace goods which have different surface patterns regardless of the arrangement of the respective gripping opening thereon. Moreover, the hook-shaped grippers which are turnably mounted on the gripper shaft provide for an automatic action so that no additional force takes place in the event when, for example, one gripper does not engage into a gripping opening. Thereby, damages to the material are prevented.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
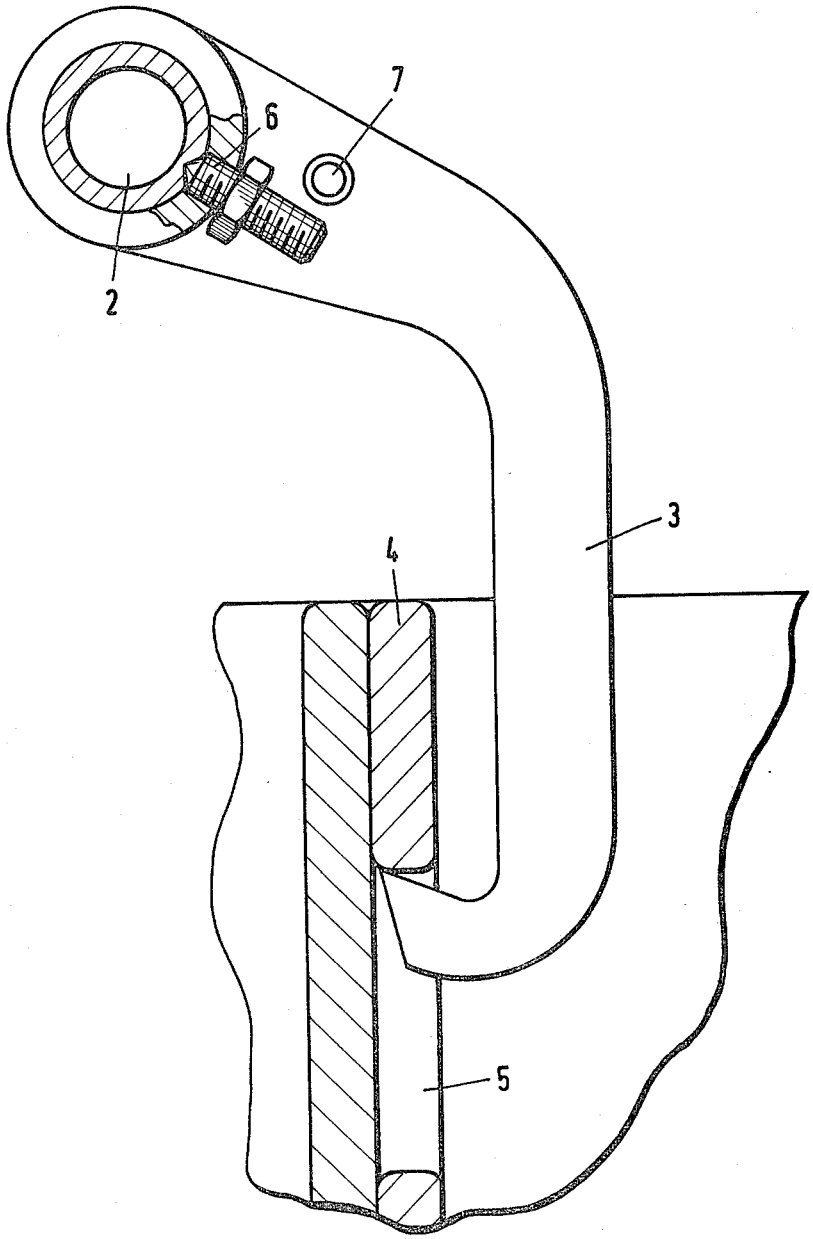
FIG. 1 is a lateral view of a gripper of an arrangement for displacing piece goods in accordance with the present invention.
Figure 2:
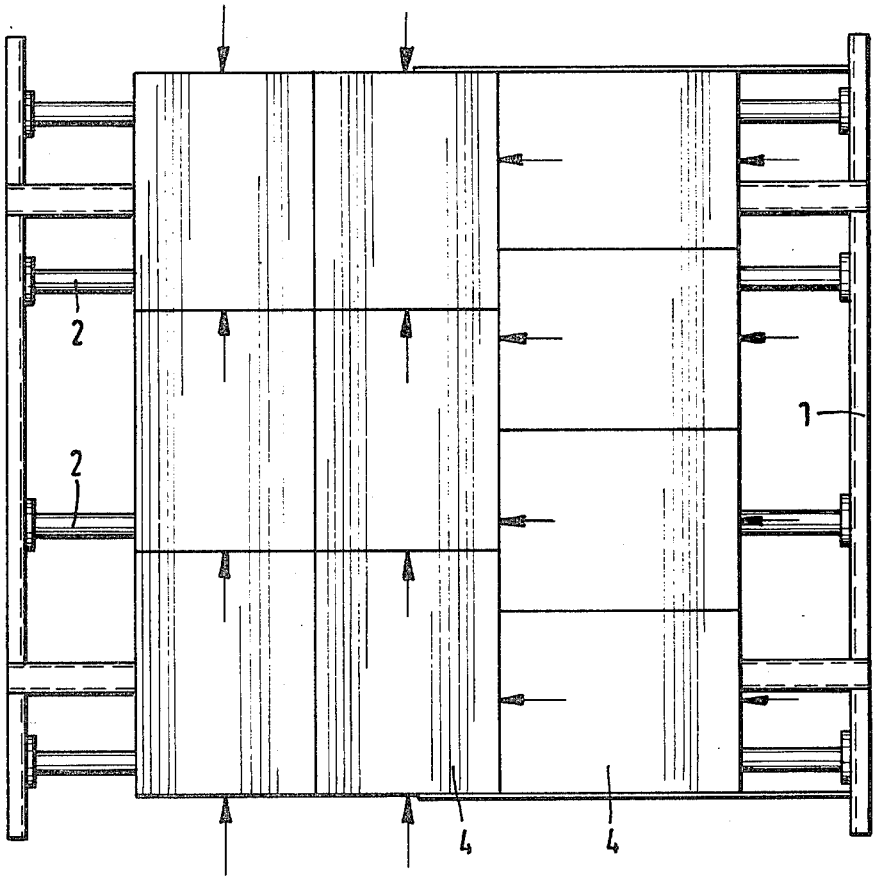
FIG. 2 is a view from below of the arrangement in accordance with the present invention.

An arrangement for displacing or turning piece goods in accordance with the present invention has a frame identified by reference numeral 1 and a plurality of gripper shafts 2 supported on the frame. The gripper shafts are turnable by a not-shown device within a predetermined angular region so as to provide gripping of piece goods from a not-shown transporting device.

Hook-shaped grippers 3 are arranged on the gripper shafts 2. The number of the grippers are determined in correspondence with given position pattern of piece goods 4. This position pattern can be varied at random in accordance with arrangement of the individual piece goods 4. The grippers 3 are provided in the maximum required number, taking into consideration the above-mentioned different surface pattern of the piece goods.

The piece goods 4 to be worked have a plurality of openings 5 provided in its lateral surfaces. The hook-shaped grippers 3 can engage in the openings 5. When a piece good having a certain position pattern is worked, it is possible that the openings are arranged in accordance with the pattern which does not correspond with the pattern of the preceeding piece good. Thereby, only a certain number of the grippers can engage into the openings. For this purpose, the grippers 3 arranged at a respective one of the gripper shafts 2 are mounted on the shaft turnable relative thereto within a predetermined angular distance, and their hook-shaped construction is such that their center of gravity is located outside of the gripper shaft 2.

In open position, a stop 6 provided on the gripper shafts abuts against a follower pin 7, whereby the hook-shaped gripper 3 is retained in the turned-off position. When it is necessary to engage a piece good, the gripper shaft 2 is turned by a not-shown moving device, and the gripper 3 automatically fall into the gripping openings 5 of the respective box 4 because of the above-mentioned particularly selected location of the center of gravity. Some of the grippers engage into the openings 5. However, other grippers which are arranged at locations whereat no gripping openings 5 are available, unobjectionable lie under the action of gravity on the upper surface of the piece goods without causing damage to the latter or to the arrangement.

It will be understood that each of the elements described above, or two or more together, may also find a useful application in other types of constructions differing from the types described above.

While the invention has been illustrated and described as embodied in an arrangement for displacing piece goods it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An arrangement for displacing piece goods provided in a plurality of rows and having a plurality of gripping openings arranged in accordance with different patterns, comprising a plurality of supporting shafts arranged in a plurality of rows; and a plurality of grippers mounted on said supporting shafts, said grippers being mounted on said supporting shafts so that when one of said grippers comes into contact with the piece goods at locations whereat no openings are provided, all other of said grippers can unobjectionable engage in the openings of the piece goods arranged in a plurality of rows and in accordance with any of the different patterns, said grippers being provided in such a number that they can engage in the openings arranged in a plurality of rows and in accordance with any of the different patterns, wherein said grippers are movable between a self-holding position and a releasing position, said shafts being rotatable to an opening position; and further comprising means for moving said grippers from said self-holding position to said releasing position upon rotation of a respective one of said supporting shaft to said opening position; wherein said moving means included a stop provided on each of said supporting shafts, and a follower pin provided on each of said gripper and cooperating with said stop of a respective one of said supporting shafts is rotated to said opening position its stop lifts a respective one of said grippers to the releasing position in engagement with its follower pin, whereas when said one shaft is rotated in an opposite direction its stop releases the respective gripper because of disengagement from said follower pin and the respective gripper falls to the self-holding position under the action of gravity.

2. An arrangement as defined in claim 1, wherein said grippers are mounted on said supporting shafts so that they are movable relative thereto within a predetermined angular region and outside their center of gravity.

3. An arrangement as defined in claim 1, wherein said grippers mounted on said supporting shafts are hook-shaped.

* * * * *